US008695678B2

(12) United States Patent
Kraeutler

(10) Patent No.: US 8,695,678 B2
(45) Date of Patent: Apr. 15, 2014

(54) QUICK-OPERATING DOOR HAVING AN IMPROVED LATERAL SEAL

(75) Inventor: Bernard Kraeutler, Dunieres (FR)

(73) Assignee: Nergeco (FR)

( * ) Notice: Subject to any disclaimer, the term of this patent is extended or adjusted under 35 U.S.C. 154(b) by 0 days.

(21) Appl. No.: 13/511,304

(22) PCT Filed: Nov. 27, 2009

(86) PCT No.: PCT/FR2009/052329

§ 371 (c)(1), (2), (4) Date: Aug. 2, 2012

(87) PCT Pub. No.: WO2011/064463

PCT Pub. Date: Jun. 3, 2011

(65) Prior Publication Data

US 2012/0291966 A1 Nov. 22, 2012

(51) Int. Cl.
*E06B 3/48* (2006.01)

(52) U.S. Cl.
USPC ..... 160/84.06; 160/207

(58) Field of Classification Search
USPC ..... 160/84.06, 84.04, 264, 207, 348, 38, 39
See application file for complete search history.

(56) References Cited

U.S. PATENT DOCUMENTS

| | | | | |
|---|---|---|---|---|
| 2,667,218 | A * | 1/1954 | Collins | 160/84.04 |
| 4,317,481 | A * | 3/1982 | Oswald | 160/84.04 |
| 4,375,232 | A * | 3/1983 | Heescher et al. | 160/84.06 |
| 4,397,347 | A * | 8/1983 | Brabant | 160/231.2 |

(Continued)

FOREIGN PATENT DOCUMENTS

| | | |
|---|---|---|
| FR | 2488646 A1 | 2/1982 |
| FR | 2857688 A1 | 1/2005 |
| FR | 2934003 A1 | 1/2010 |

OTHER PUBLICATIONS

International Preliminary Report on Patentability and Written Opinion issued Jul. 12, 2012 by Bureau International de l'OMPI re: PCT/FR2009/052329; pp. 9; cting: FR 2 934 003 A1, FR 2 857 688 A1 and FR 2 488 646 A1.

(Continued)

*Primary Examiner* — David Purol
(74) *Attorney, Agent, or Firm* — Cantor Colburn LLP

(57) ABSTRACT

The invention relates to a quick-operating door designed for opening and closing an aperture in a partition including: a support structure including in particular two vertical jambs (2) above which is a shaft driven by electromechanical means, each of the two vertical jambs (2) having an outer planar bearing surface (6) and a slideway (5), and a flexible curtain (4) designed to occupy a closed position in which the curtain (4) blocks the aperture and an open position in which the curtain (4) clears access to the aperture, the curtain (4) incorporating at least two transverse reinforcing bars (19) provided, at each of the ends thereof, with a tip in the form of a crank which engages with the guiding slideway in each jamb. According to the invention, the door has at least one transverse section (22) of the curtain (4) delimited by two transverse reinforcing bars (19) including two panels (23) connected to one another by means of a hinge (24), each panel (23) consisting of at least two strips (25) of a flexible material between which is inserted a layer of material stiffening, weighting and insulating said panel (23) for the purpose of keeping the transverse section (22) bearing on a planar surface (6) of each jamb (2).

11 Claims, 3 Drawing Sheets

(56) References Cited

U.S. PATENT DOCUMENTS

| | | | | | |
|---|---|---|---|---|---|
| 4,422,492 | A | * | 12/1983 | Bledsoe | 160/84.04 |
| 4,776,379 | A | * | 10/1988 | Kraeutler | 160/84.06 |
| 4,824,505 | A | * | 4/1989 | Kraeutler | 156/227 |
| 4,889,176 | A | * | 12/1989 | Nilsson | 160/264 |
| 5,072,767 | A | * | 12/1991 | Kraeutler | 160/84.01 |
| 5,246,053 | A | * | 9/1993 | Kraeutler | 160/84.02 |
| 5,379,823 | A | * | 1/1995 | Kraeutler | 160/271 |
| 5,857,511 | A | * | 1/1999 | Judkins | 160/348 |
| 6,116,319 | A | * | 9/2000 | Simon | 160/84.01 |
| 6,192,960 | B1 | * | 2/2001 | Simon | 160/84.06 |
| 6,672,360 | B1 | * | 1/2004 | Kraeutler | 160/84.06 |
| 7,017,644 | B1 | * | 3/2006 | Kraeutler | 160/271 |
| 2007/0006978 | A1 | * | 1/2007 | Krauetler | 160/84.06 |

OTHER PUBLICATIONS

International Search Report and Written Opinion issued Apr. 14, 2010 by European Patent Office re: PCT/FR2009/052329; pp. 9; cting: FR 2 934 003 A1, FR 2 857 688 A1 and FR 2 488 646 A1.

* cited by examiner

Fig. 1
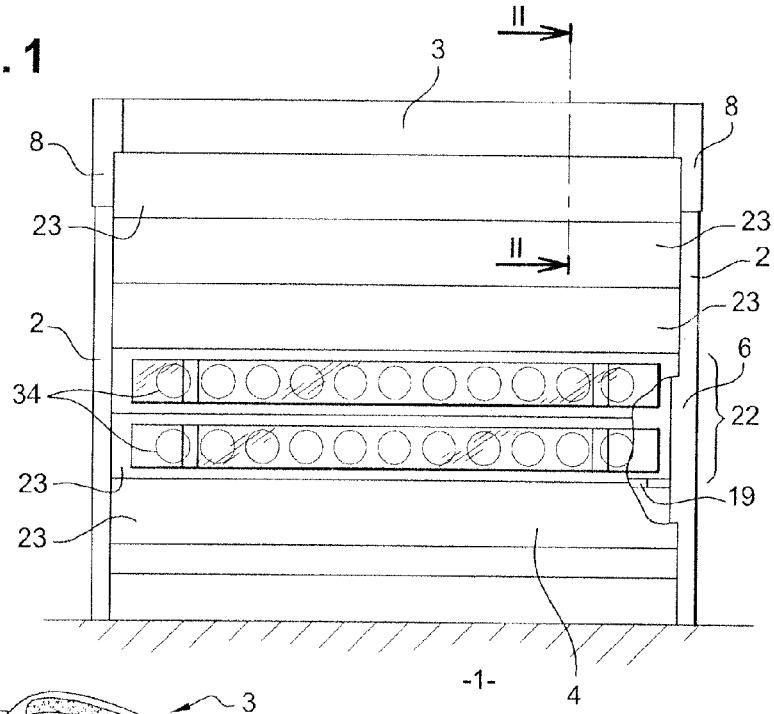
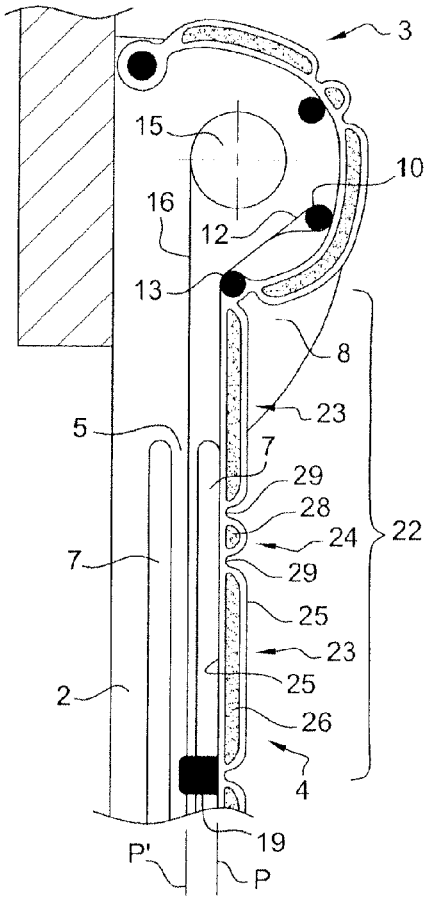
Fig. 2

QUICK-OPERATING DOOR HAVING AN IMPROVED LATERAL SEAL

TECHNICAL FIELD

The present invention concerns a quick-operating door with flexible curtain.

BRIEF DISCUSSION OF RELATED ART

A door with flexible curtain conventionally has a structure comprising two side jambs which carry a shaft at their upper end; the rotation of this shaft allows the lifting and lowering of the curtain in relation to the passing of persons or vehicles through the door under consideration.

The use of a door with flexible curtain is widespread on account of the rapid action of the curtain on opening and closing; this type of door globally contributes to a better energy balance since heat exchanges are limited between the spaces separated by the door under consideration.

Other than the heat exchanges which occur on opening and closing of the curtain, the problem is also raised of the static seal between the curtain and the structure of the door.

When the door is in closed position, it is important that the curtain should ensure a satisfactory seal with the supporting structure.

The seal with the door sill can be managed by a sill bar in flexible material—for example a foam-cladded helical spring which can be pressed down against the sill.

On the other hand, the seal between the side vertical edges of the curtain and the jambs of the door structure may prove to be difficult to obtain.

From document FR 2 857 688 a door is known having a flexible curtain in PVC fabric whose curtain comes to be applied onto the outer surface of the door jambs. For this purpose, the curtain which has horizontal stiffener bars is equipped with guiding devices engaged at each end of the stiffener bars; these guiding devices ensure both the transmission to the jambs of wind forces to which the curtain is subjected, and the applying of the curtain onto the outer surface of the jambs so that the side edges of the curtain lie flat against the uprights.

This door proves to be particularly adapted for closing an outside bay.

The action of the wind effectively contributes to increasing the contact of the curtain against the jambs, which is beneficial for the sealing of the door.

The door such as defined by document FR 2 857 688 is globally satisfactory.

However it can be ascertained in some cases that the vertical edges of the curtain do not lie fully flat against the application surfaces provided for this purpose on each of the jambs.

The fact that the curtain is not applied fully flat against the bearing surfaces of the jambs may raise problems in some modes of use.

One case in which sealing is critical concerns the closing of the access to a refrigerated storage area for example. In this type of application the difference in temperature either side of the door may be several tens of degrees and any sealing defect translates as a major energy loss.

BRIEF SUMMARY

Within this technical context the invention proposes a door with flexible curtain which ensures better management of the lateral sealing between the curtain and the door structure.

The invention concerns a quick-operating door intended to open or close a bay formed in a partition comprising:

- a support structure particularly including two vertical jambs surmounted by a shaft driven by electromechanically means, each of the vertical jambs having an outer planar bearing surface and a slideway; and
- a flexible curtain designed to assume a closed position in which the curtain closes the bay and an open position in which the curtain clears the access to the bay, the curtain incorporating at least two transverse reinforcing bars equipped at each of their ends with a crank-shaped tip engaged in the guiding slideway of each jamb.

In addition, the door has at least one transverse section of the curtain delimited by two flexible transverse reinforcing bars comprising two panels connected together by a hinge, each panel being formed of at least two strips of flexible material between which a layer of material is inserted stiffening, weighting and insulating the said panel with a view to maintaining the transverse section bearing upon a planar surface of each jamb.

The invention therefore proposes a door which provides lateral sealing that is much greater than that provided by prior art doors. This sealing is obtained through the presence of transverse sections formed of hinged panels. Unlike the doors in the prior art, the door of the invention allows the flat applying of the curtain against the planar outer surface of the jambs that does not undergo any degradation. This property of the door according to the invention is obtained by the fully original structure of its curtain which comprises transverse sections which themselves are formed of panels which behave such that they are able to come to lie flat against the jambs irrespective of outside stresses (wind, overpressure . . . ). The achieving of this seal is not detrimental to the usual qualities of quick-opening doors i.e. in particular reduced manufacturing costs and reduced costs of use through limiting heat losses and the resilience of the curtain in the event of impact with a vehicle.

Preferably the layer of stiffening, weighting and insulating material can be formed of honeycomb foam.

According to one possibility, the hinge which forms the articulation between two panels is formed by at least one transverse weld line which joins at least two strips of flexible material. The weld line allows the joining together of the two or three strips and means that the constituent material of the strips locally loses its flexibility. This local hardening creates a hinge which will allow gate-folding of the transverse section.

Also the hinge which forms the articulation between two panels is formed by a ring of rigidifying weighting and insulating material surrounded by two weld lines.

In addition each transverse reinforcing bar at its two ends has a crank-shaped tip allowing the curtain to be guided over a guide plane defined by the slideways of the jambs in which the crank-shaped tips engage, the said guide plane being offset from the plane of the curtain defined by the outer surfaces of the jambs.

To improve the seal, the outer surfaces of the jambs are provided with a coating which promotes the contact between the screen and the jambs. It is a coating which promotes contact by an adapted coefficient of adhesion.

In practice, the jambs are surmounted by consoles ensuring the guiding of the shaft; in addition the jambs and consoles are formed of material having low thermal conductivity, lower than that of steel.

If the door is intended to close a refrigerated storage area, the jambs can be equipped with a heating element.

Also the door may comprise a flexible cover formed of at least two strips of a flexible material between which there is inserted a layer of stiffening, weighting and insulating material, the flexible cover being stretched over transverse bars.

In one advantageous embodiment, the door comprises a folding member connected to two successive transverse reinforcing flexible bars, the folding member comprising two branches each connected to a flexible transverse reinforcing bar connected by a hinge, the end of each of the branches being secured in the vicinity of a reinforcing bar.

BRIEF DESCRIPTION OF THE DRAWINGS

For good comprehension of the invention, a description is given with reference to the appended drawings which, as non-limiting examples, illustrate one embodiment of a door of the inventions.

FIG. 1 is a front view of a door.

FIG. 2 is a cross-sectional view along II-II in FIG. 1.

DETAILED DESCRIPTION

Figure 3:
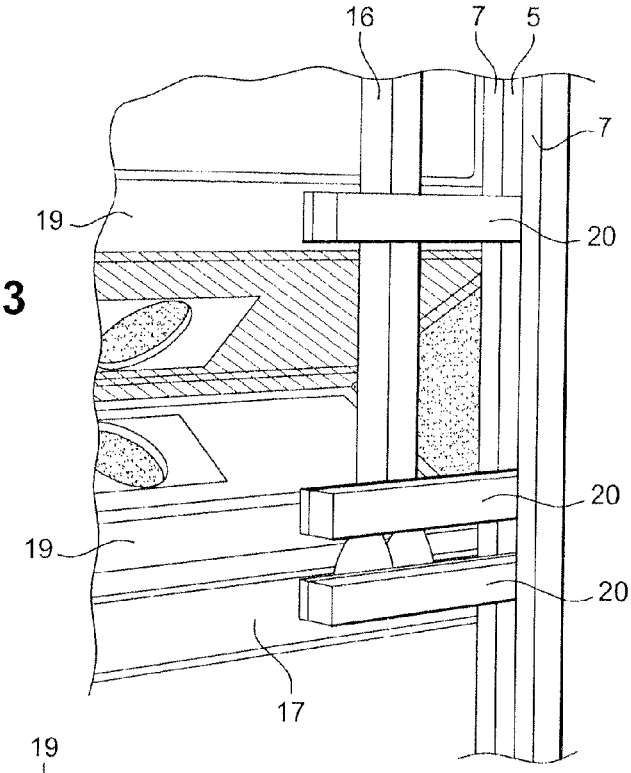
FIG. 3 shows the curtain of the door in lifting phase.

The door 1 according to the invention is a folding door. The door has a structure which surrounds a bay arranged in a wall which separates two spaces. The structure comprises two vertical jambs 2 which are arranged either side of the bay, and a transverse cover 3 which borders the lintel of the bay.

The structure of the door therefore integrates two jambs of which one can be clearly seen in a side view in FIG. 2.

These jambs 2 can be made in mechanically welded sheet metal or in a composite material of glass fibre and resin type.

The function of the jambs 2 is to ensure the guiding of a curtain 4. For this purpose, the jambs 2 each have a slideway 5 and a planar bearing surface 6 on the outer side. The slideway 5 is delimited by two wings 7 whilst the planar bearing surface 6 is formed by the outer surface of the jamb 2.

Each jamb 2 is surmounted by a console 8 on which means are secured for hanging and driving the curtain 4. The consoles 8 are also used to secure the transverse cover 3.

The curtain 4 is hung from a transverse bar 10 which extends between the two consoles 8. In practice, the curtain 4 has a hem 12 in which the transverse bar 10 is inserted. The lowering of the curtain 4 is guided by a transverse bar 13 which extends between the consoles 8.

To ensure lifting of the curtain 4, the door is equipped with a shaft 15 which is able to rotate in bearings inserted in the consoles 8. A propelling assembly composed of a motor and gear allows the shaft 15 to be set in rotation.

The shaft 15 allows lifting of the curtain 4 by means of straps 16 of which one end is attached to the shaft 15 and the other end is attached to a bar 17 (cf. FIG. 3) which is positioned at the lower edge of the curtain 4. Therefore, when the shaft 15 is set in rotation, the straps 16 wind around the shaft and the lower edge of the curtain 4 is lifted thereby opening the passageway.

FIG. 2 in particular allows better understanding of the design of the curtain 4 which is fully specific to the invention.

The curtain 4 has several transverse reinforcing bars 19 whose function is to transmit to the jambs the forces exerted upon the curtain 4. These transverse reinforcing bars 19 are preferably in composite material and have an overall flexibility enabling them to move out of at least one slideway 5 in the event of an impact.

The transverse reinforcing bars 19 are equipped at each of their ends with a crank-shaped tip 20. By crank-shaped tip in the present document is meant an elbowed end part which has a pin which engages in a transverse bar 19 and a pin which engages in the slideway 5 of a jamb. These two pins are joined by an elbowed part so that the two pins are offset but remain parallel.

All the transverse reinforcing bars 17 and 19 are equipped with crank-shaped tips 20; as a result the guiding plane P' of the curtain 4 as defined by the slideways 5 of the jambs 2 is offset from the plane of movement P of the curtain 4 which is defined by the planar bearing surface 6.

Therefore the side edges of the curtain 4 bear against the front surfaces of the jambs. It is at this level that sealing losses may occur on account of imperfect flat application of the curtain 4 against the front surfaces of the jambs.

For this purpose, the curtain 4 has a fully original structure since in the invention provision is made so that at least one section 22 (and in practice all the sections 22) of the curtain 4 delimited by two transverse reinforcing bars 19 are formed of the two superimposed panels 23 connected together by a hinge 24.

These panels 23 are formed of two strips 25 in flexible PVC fabric between which there is arranged a layer 26 in honeycomb foam of polyurethane or equivalent type. The panels 23 thus formed have a technical effect at two levels.

First, the section 22 formed of these two panels 23 connected by a hinge 24 is substantially more rigid and heavier than the simple fabric found on prior art doors. This means that the successive panels which form the curtain 4 can achieve a very good seal with the jambs since they prevent the gaping known to occur with prior art doors.

Second, the curtain 4 formed of successive sections 22 of two superimposed panels 23 provides very good heat insulation. The door equipped with this curtain 4 can be used in particular to close the bay of refrigerated storage areas.

More specifically a section 22 of curtain 4 is formed by:

laying a first strip 25 of PVC fabric on a table;

laying on this strip two parallel layers 26 of insulating material;

laying a second strip 25 of PVC fabric on the first strip and on the two layers of insulating material;

forming weld lines along the layers of insulating material.

The junction between two adjacent sections 22 is achieved by two bands of PVC fabric which form a sheath in which a transverse reinforcing bar is engaged.

This manner of fabricating the curtain 4 has the advantage of allowing the forming of a curtain 4 of which one side (the side formed by the strip laid on the table) is fully planar. This is an important point for managing the seal of the jambs since in this way a door is formed whose curtain 4 is weighted and rigid and whose side which comes to bear against the jambs is planar.

It is to be noted that the hinge which forms the junction between two panels 23 may have a ring 28 in stiffening, weighting and insulating material surrounded by two weld lines 29.

The transverse cover 3 which covers the drive shaft may be fabricated in the same manner as the curtain 4. In other words the cover 3 is formed of two strips between which there are inserted two layers of insulating material and a ring of insulating material. The cover has two sheaths in which transverse bars are engaged. The positioning of the cover in an arc of a circle around the shaft is achieved by transverse bars. FIG. 2 shows the transverse cover covering the curtain 4 which contributes towards the good sealing and insulating of the door.

When in use the door operates as follows.

In the closed position of the door, the curtain 4 is lowered between the jambs and is applied flat against the outer surface of the jambs.

The lifting of the curtain 4 takes place by setting the shaft 15 in rotation. The straps 16 wind around the shaft 15 and the lower part of the curtain 4 is lifted by gate-folding of the sections 22. By gate-folding is meant folding relative to the hinge 24 of the fold allowing the two panels 23 to come to bear upon each other.

Figure 4:
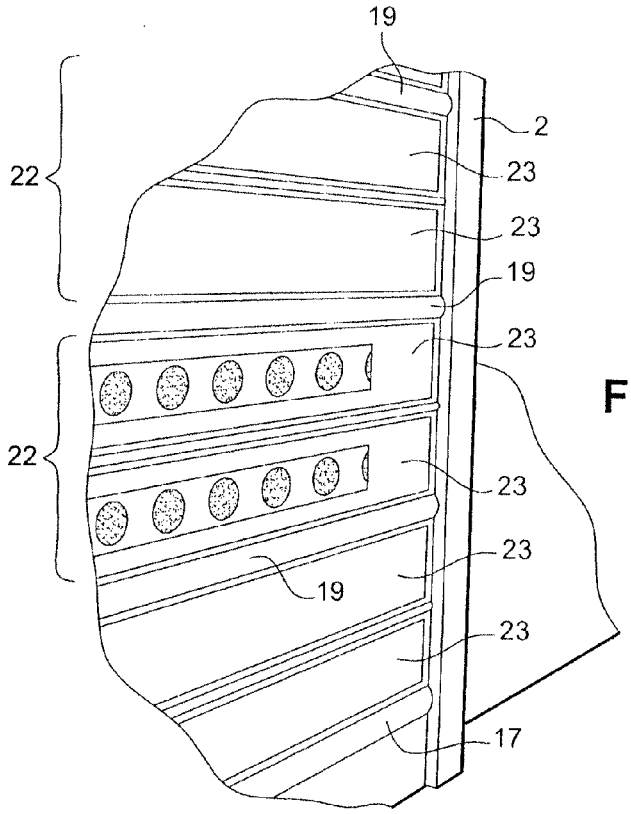
FIG. 4 shows the curtain in closed position.
Figure 5:
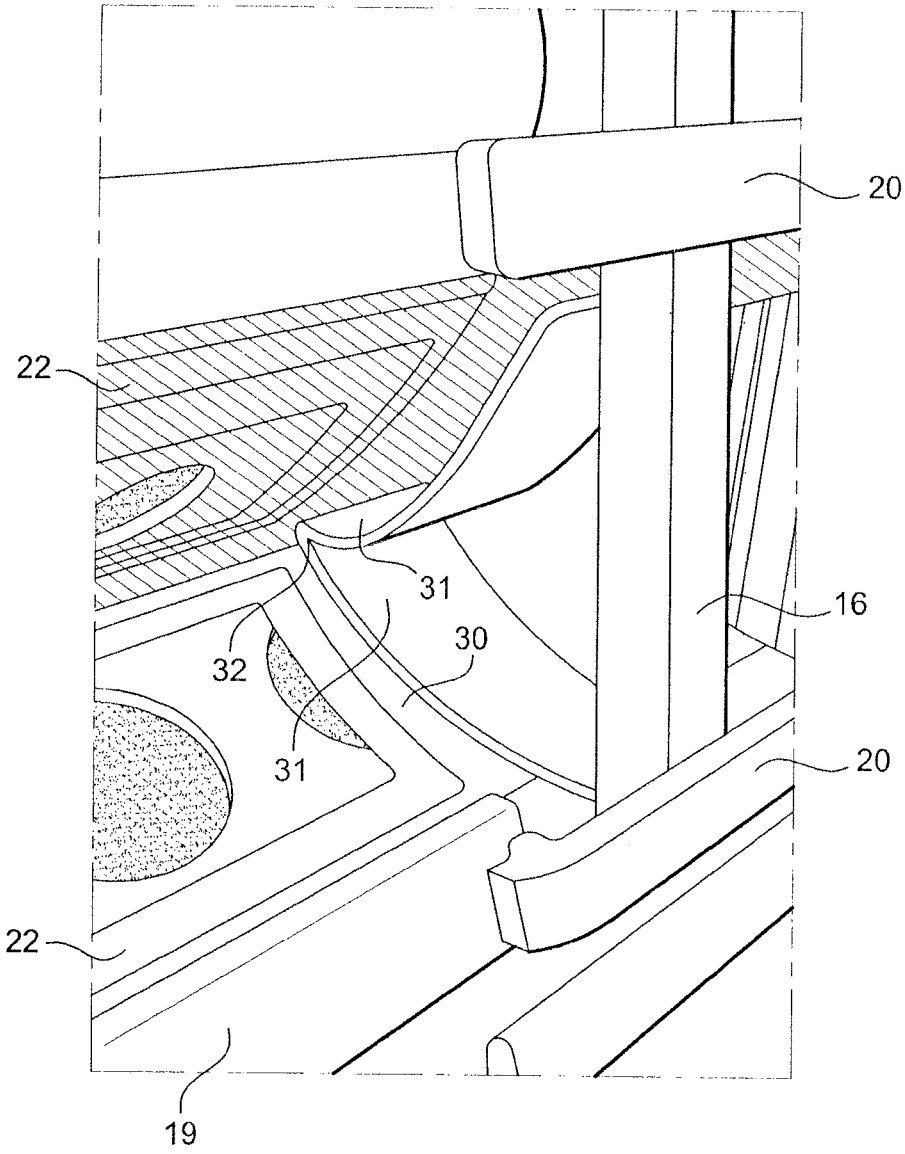
FIG. 5 show a variant of embodiment of the curtain.

FIGS. 4 and 5 show the formation of the fold of each section 22 of the curtain 4.

FIG. 4 shows the traction exerted by the straps 16 on the lower reinforcing bar; starting with section 22 adjacent the lower bar, the sections 22 gate-fold successively under the driving effect of the lower transverse reinforcing bar.

The folding of the sections 22 which form the curtain 4 can be assisted by a folding member 30. The folding member 30 in flexible plastic material comprises two branches 31 connected by a hinge 32. Each of the branches of the folding member is flanged on a crank-shaped tip 20. Therefore, when the two crank-shaped tips 20 draw near at the time of lifting of the curtain 4, the arms of the folding member 30 draw near to each other and the hinge is compelled to draw away from the plane of the curtain 4; on this account, the folding member comes to bear on the section 22 of the curtain 4 at the height of its hinge 24 and thereby facilitates the folding of the section 22.

As can be seen in FIG. 4 it is possible to preserve visibility through the curtain 4 by inserting one or more panels of transparent windows and forming cut-outs 34 e.g. circular in the layer of insulating material.

If the door is more particularly intended to close refrigerated storage areas, the jambs 2 and the consoles 8 are advantageously in composite material which has a more favourable coefficient of thermal conductivity than stainless steel which is generally used. It can be envisaged to integrate electric resistances in the jambs to melt any ice which may be formed between the jambs and the curtain 4.

Evidently the invention is not limited to the embodiment described above as a non-limiting example, but on the contrary encompasses all forms of embodiment. For example, if necessary, the curtain 4 may comprise several layers of insulating material.

The invention claimed is:

1. A quick-opening door intended to open or close a bay made in a partition, comprising:

a support structure including two vertical jambs surmounted by an electromechanically driven shaft, each of the vertical jambs having an outer planar bearing surface and a slideway, a flexible curtain moveable between a closed position in which the curtain closes the bay and an open position in which the curtain clears an access to the bay, the curtain incorporating at least two transverse reinforcing bars equipped at each of their ends with a crank-shaped tip engaged in the guiding slideway of each jamb, wherein the door has at least one transverse section of the curtain delimited by two transverse reinforcing bars and comprising two panels connected together by a hinge, each panel being formed of at least two strips of flexible material between which there is inserted a layer of material stiffening, weighting and insulating the panel so as to maintain the transverse section bearing upon the planar surface of each jamb, and wherein the crank-shaped tips of each transverse reinforcing bar allows the curtain to be guided over a guide plane defined by the slideways of the jambs in which the crank-shaped tips engage, the guide plane being offset from the plane of the curtain defined by the outer bearing surfaces.

2. The quick-operating door according to claim 1 wherein the layer of stiffening, weighting and insulating material is formed of honeycomb foam.

3. The quick-operating door according to claim 1 wherein the hinge which forms the articulation between two panels is formed by at least one transverse weld line which joins at least two strips of flexible material.

4. The quick-operating door according to claim 1 wherein the hinge which forms the articulation between two panels is formed by a ring in stiffening, weighting and insulating material surrounded by two weld lines.

5. The quick-operating door according to claim 1 wherein the outer bearing surfaces of the jambs are provided with a coating which promotes the contact between the curtain and the jambs.

6. The quick-operating door according to claim 1 wherein the jambs are surmounted by consoles ensuring the guiding of the shaft and the jambs and consoles are formed of material having thermal conductivity lower than that of steel.

7. The quick-opening door according to claim 1 wherein the jambs are equipped with a heating element.

8. The quick-opening door according to claim 1 wherein the door comprises a flexible cover formed of at least two strips of a flexible material between which there is inserted a layer of a stiffening, weighting and insulating material, the flexible cover being stretched over transverse bars.

9. The quick-operating door according to claim 1 wherein the door comprises a folding member placed between two successive transverse reinforcing bars, the folding member comprising two branches connected by a hinge, the end of each of the branches is secured to the curtain in the vicinity of a transverse reinforcing bar.

10. The quick-operating door according to claim 1 wherein at least one jamb has a cavity able to be filled with a heat insulating material.

11. The quick-operating door according to claim 1 wherein at least one transverse reinforcing bar is formed of a material having flexibility enabling the bar to move out of at least one slideway in the event of a force applied thereupon.

* * * * *